United States Patent [19]

Matsui

[11] Patent Number: 4,649,788

[45] Date of Patent: Mar. 17, 1987

[54] STRING RETAINING MECHANISM FOR GUITARS AND THE LIKE STRINGED INSTRUMENTS

[75] Inventor: Kazuhiro Matsui, Aichi, Japan

[73] Assignee: Hoshino Gakki Co., Ltd., Japan

[21] Appl. No.: 738,055

[22] Filed: May 24, 1985

[30] Foreign Application Priority Data

May 25, 1984 [JP] Japan ..... 59-77561[U]

[51] Int. Cl.[4] ..... G10D 3/04; G10D 3/14

[52] U.S. Cl. ..... 84/297 R; 84/298; 84/312 R; 84/313

[58] Field of Search ..... 84/297 R, 298, 299, 84/312 R, 313

[56] References Cited

U.S. PATENT DOCUMENTS

| | | | |
|---|---|---|---|
| 2,813,448 | 11/1957 | Robinson | 84/299 X |
| 2,949,806 | 8/1960 | Turman | 84/313 X |
| 4,171,661 | 10/1979 | Rose | 84/313 |
| 4,497,236 | 2/1985 | Rose | 84/298 |
| 4,506,585 | 3/1985 | Desmond | 84/298 |
| 4,572,049 | 2/1986 | Tanaka et al. | 84/313 |

*Primary Examiner*—Benjamin R. Fuller

*Attorney, Agent, or Firm*—Ostrolenk, Faber, Gerb & Soffen

[57] ABSTRACT

A bridge and means for mounting the rear end of each of a plurality of strings on said bridge, the bridge including a plurality of saddles to which strings are individually attached wherein each saddle is adjustable longitudinally of the string in order to vary the effective length of the string for harmonious tuning and the saddle is adjustable without varying the effective length of the string in order to provide a fine tuning variation in tension for pitch. The invention relates to the specific means of mounting the end of the string on its individual saddle of the bridge wherein a substantially tubular member is provided with a groove extending downwardly, substantially normal to the body of the instrument to which the bridge is secured. The string passes through said groove and a bead on the end of the string initially anchors the string with respect to the groove. The string is anchored with respect to the saddle by a clamping jaw bearing against the string and a bearing surface in the saddle moved into tight engagement by a screw. The string and its bearing surface extends on one side of the screw which effects the clamping operation and the adjustments for tension and effective length extend on the opposite side of the screw.

5 Claims, 3 Drawing Figures

STRING RETAINING MECHANISM FOR GUITARS AND THE LIKE STRINGED INSTRUMENTS

The present invention relates to a string retaining mechanism for a guitar or other stringed instruments and more particularly to a string retaining mechanism which will nevertheless permit fine tuning of the string either for harmonic or pitch purposes or both. That is, for changing the effective length of the string or the tensio of the string. This application is one of three applicatiions for patent filed simultaneously and, until further indentification by serial numbe and actual filing date is available, have been given the temporary designations entitled "Fine Tuning Mechanism for Guitars and the Like Stringed Instruments", Ser. No. 729,671; and entitled "Stringed Instruments—Tremolo Bar Mounting, Ser No. 741,445.

BACKGROUND OF THE INVENTION

Musical strings are tuned by changing their effective length or by changing the tension thereon or both. The change in the effective length produces a change known as harmonic tuning. The change in the tension results in a change in pitch. A string is mounted at or behind the bridge at the rear end and on or in connection with a tuning peg at the front or neck of the instrument. Turning the tuning peg tensions the string appropriately and produces the desired pitch. Placing a finger on the string between the mounting means at the ends changes the effective length of the string and, therefore, changes its frequency harmonically. The string may, in the firest instance, be initially tuned by turning the tuning peg at the neck to produce appropriate tension in order to obtain a desired pitch. Then, at the bridge, the string may be fine tuned to exactly the desired tension and pitch. The string may also be appropriately tuned with respect to harmonic tuning and therefore changing its effective length by an additional string engaging device at or near the bridge which accomplishes this purpose to effect harmonic tuning and is, of course, further harmonically tuned by the use of the fingers during playing in changing its effective length. It is convenient to describe the present invention with respect to a guitar, although the invention is applicable to other stringed instruments.

The principal components of the guitar are the body, the peg head, and the elongated nack which extends between the body and the peg head. The strings extend essentially in parallel spaced relation to one another between the bridge located on the body and the head of the guitar. It is also common to anchor a clamp to one end of a string on the body, usually at the bridge, but in certain instruments behind the bridge. The other end of the string is received on a tuning peg individual to the string located on the peg head which pulls the string to adjust its tension.

In many guitars, the connection points for each string include a nut located on the neck near the head and a second point located on the bridge of the guitar. To harmonically tune the guitar, these points are moved closer or further apart as required. Various means for obtaining adjustment with respect to pitch and adjustment with respect to harmonic tuning are described in associated applications referred to above. These various means are here briefly described in order to provide the appropriate setting for the present invention.

One of the essential elements of the present invention is the mounting of the string on the bridge in such a manner that the ability to adjust both the harmonic and pitch tuning of the string is retained. Essentially, the invention is directed to the structure of the string holding part of the guitar carried by the bridge. The tuning member is freely rotatable on the principal bridge saddle, hereinafter described. A holding groove receives a securing member of the bridge which has a strig fixing or attaching jaw and has a tightening screw running through it, the tightening screw being engageable not only into the tuning member but also with the string so that the end of the string is fixedly held at the jaw. One of the essential elements of the present invention is that the anchoring of the string at the bridge nevertheless permits full accessibility to the fine tuning structure.

Fine tuning structures are described in U.S. Pat. No. 4,497,236 to Rose which is more fully referred to in application Ser. No. 729,671 entitled "Fine Tuning Mechanism For Guitars and the Like Stringed Instruments", filed simultaneously herewith. The fine tuning mechanism disclosed and the particular bridge is also described in said application; so much of the bridge is here described as is necessary for a full understanding of the specific invention relating to the means for mounting the bridge end of the string.

SUMMARY OF THE INVENTION

The saddle of the bridge is provided with a downwardly extending member having a groove therein for receiving the end of a string. This is in addition to the tremolo arm where one is provided. The downwardly extending member is part of a tuning member which is capable of being adjusted with respect to harmonic tuning and pitch tuning. The string is anchored by a fixing member which has a string fixing jaw and which also has a tightening screw running through the holding groove and screwed into the tuning member and the string so that the string is held in the string fixing jaw.

The object of the present invention is, therefore, to provide a simplified string fixing member to retain the bridge end of a string which is so arranged that the string may be fine tuned for harmonious tuning as well as for pitch tuning and where the string retaining member will be readily adjustable for tuning both for the harmonious mode and the pitch mode without interference from the string mounting and vice versa.

The foregoing and many other objects of the present invention will become apparent in the following description and the accompanying drawings.

BRIEF DESCRIPTIN OF THE DRAWINGS

FIG. 2 is a diagrammatic view of a conventional string mounting structure of a conventional guitar.

DESCRIPTION OF THE PREFERRED EMBODIMENTS

Figure 1:
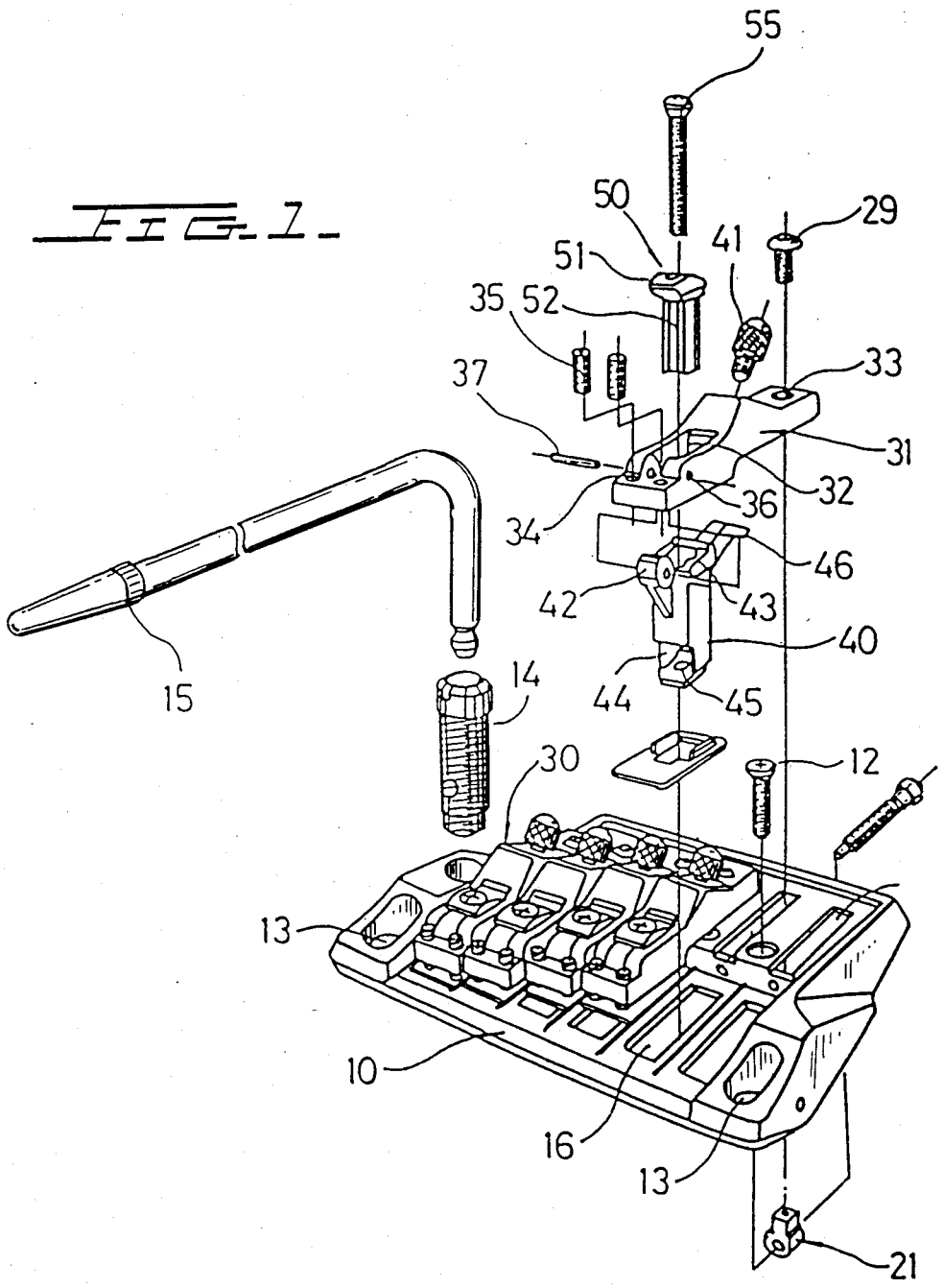
FIG. 1 is an expanded view of a bridge incorporating the present invention.
Figure 2:
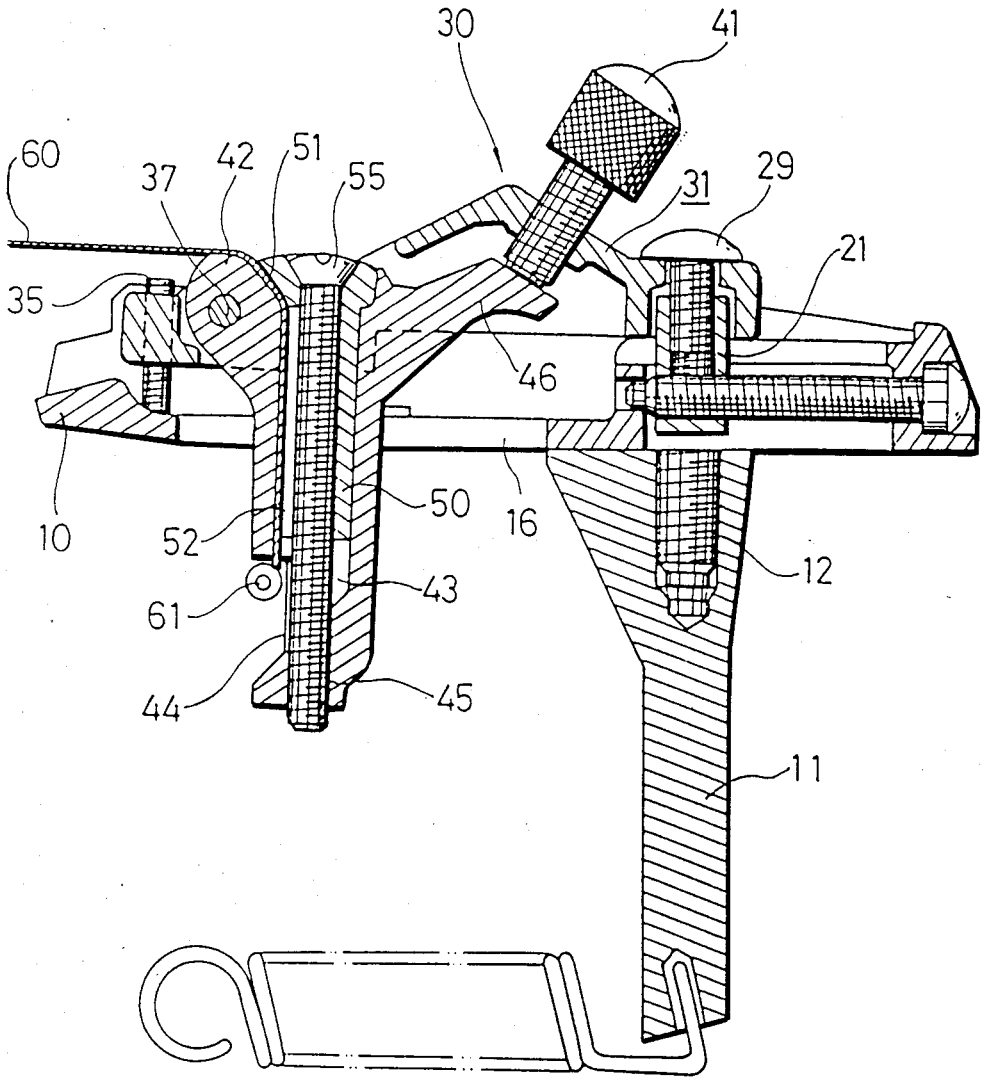
FIG. 2 is a side view partly in section of the string mounting structure.
Figure 3:
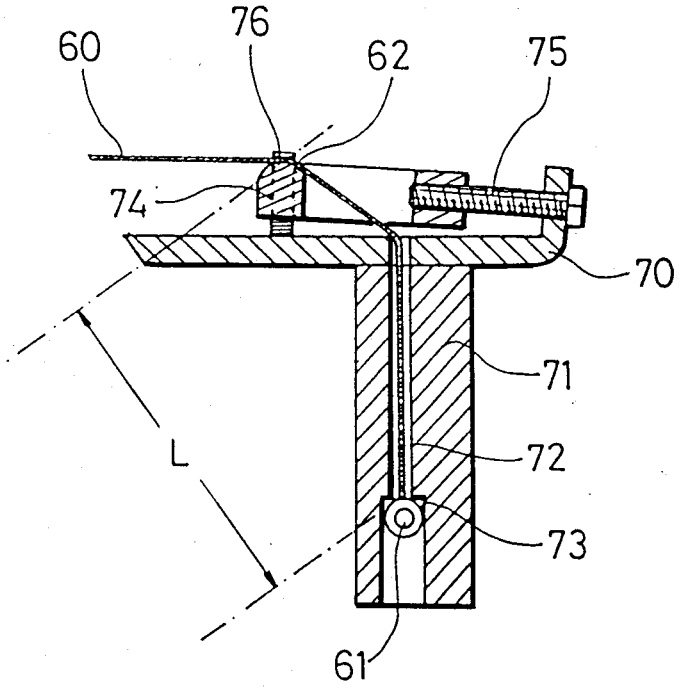
FIG. 3 PRIOR ART

Referring now to the drawings, it should be pointed out that the essential elements of the present invention are shown in FIG. 2. The prior art showing a conventional method of supporting the bridge end of a string is shown in FIG. 3. It is desirable, instead of referring back to the associated application above set forth, to describe generally the bridge structure in which the string anchoring strucutre of FIG. 2 is utilized. Hence, the initial description is a description of the structure of FIG. 1. The tuning mechanism of the bridge includes the bridge structure which has a bridge base 10 secured to the instrument by screws passing through it. The bridge base contains two rows of grooves, a forward row 16 and a rearward row 17. Each pair of grooves 16, 17 is provided for a single string. A bridge saddle 30 is located above each groove pair. A pitch tuning string tension adjusting mechanism which includes the tuning member 40 is attached to saddle 30 with the tuning member passing through the grooves 16. The tuning member 40 also includes a pivot member 42 supported on the saddle. The tuning member 40 includes a generally horizontally extending operating arm 46 and a downward tubular extension with a cutout section 44 for holding the guitar strig as described below. The bottom of the extension is provided with a threaded screw receiving hole 45.

The tuning member 40 is supported in front cut-out 32 in the body 31 of bridge saddle 30. The bearing 42 of the tuning member 40 has an axial hole which is aligned with axial holes 36 in the body 31. The bearing 42 is fixed in position to the body 31 by means of an axial pin 37 which penetrates the axial holes and the bearing and enables the tuning member to pivot. The tuning member 40 is pivotable in one direction (counter-clockwise with respect to the FIG.) by the pull of the attached guitar string and in the other direction (clock-wise) by pressing down on its arm 46. A pitch fine tuning screw 41 is screwed into the main body 31 from above to engage the arm 46 to control the pivoting of the tuning member 40. The end of the guitar string 60 (see FIG. 2) is strung over the bearing 42 and is hooked in the cutout portion 44.

In accordance with the present invention, to clamp the string 60 in place, a string securing member 50 is inerted into the cutout 32 in the body 31. The fixed jaw 51 of the string securing member 50 bears against the string 60 and presses it to the tuning member in the vicinity of the bearing 42. A string retaining screw 55 passes through the string securing member 50 and is threadedly received in threaded hole 45 located in the tuning member 40. Tightening the screw 55 presses down the jaw 51 and the string is firmly held in place. The section of the string between the bearing 42 and the cut-out 44 passes through a groove 52 in the string securing member 50. The accommodating portion 43 of the tuning member 40 is generally shaped to accommodate the string securing member 50. It should be noted also that the string 60 is held in position by the engagment of the jaw 51 and the bearing 42 where the jaw 51 is held firmly in place by the screw head of screw 55. The string is positioned in the groove 52 and held against accidental removal until it is tightened by the bead 61 at the end of the string 60 being pulled up.

Thus, it will be seen that the essential element of the string supporting member permits all adjustments which can be made between the string and the bridge to permit adjustment for pitch, harmonious tuning and other adjustments. Even though the string 60 is firmly anchored, the screws 41, 20 and 35 may be operated with the string elements firmly in place.

In order to complete the description of this operation, it is here pointed out that further assembly of the bridge saddle 30 is completed by inserting the threaded height adjustment screws 35 into the corresponding threaded holes 34 located in the body 31 of the bridge saddle 30. The bridge saddle thus assembled is lowered onto the panel of the bridge base 10, the tuning member penetrating through the groove 16 and extending below it. The saddle 30 is connected to the base 10 by means of the securing screw 39 which passes through an opening 33 and which engages the guide member 21 beneath the base 10 in FIG. 1. The harmonic tuning screw 20 passes through the guide member 21 and is adapted to move the guide member 21 back and forth along the groove as the screw 20 is rotated to change the effective initial length of the string. The tremolo arm 15 is associated with a tremolo installation sleeve 14. In assembled form the sleeve 14 is secured to the base 10 and it is engaged y tremolo arm 15. During use, the arm 15 can be pulled to pivot or rock the base 10 forwardly, thereby to relax and increase the tension on all of the strings. The hanging part 11 in FIG. 2 and the hanging part retaining screw in FIG. 1 are useful for connecting the base 10 to the body of the guitar. The remaining elements of the operatio of the bridge, which are not essential for a complete understanding of the present invention, are further described in the aforementioned pplication.

The present invention constitutes a substantial improvement over prior art as can be seen from a comparison of FIGS. 2 and 3. The structure of the string holding part of the guitar according to conventional guitar construction is such that a string 60 is inserted into the string insertion part 72 of the hanging part 71 which is provided below the bridge base 70 and the ball end 61 of the rear portion of the string is hung on the hanging part. The bridge saddl3 74 in the conventional guitar of FIG. 3 is provided with an adjustment screw 75 for longitudinal adjustment of the saddle and the adjustment screw 76 for vertical adjustment of the saddle. In such a structure, however, the front end of the string must be inserted from the string insertion position 72 on the reverse side of the guitar. This is not only highly complicated but, since a string which has once been used can be bent by the tightening screw of the peg head, it becomes impossible to use the same string again. In addition, the fulcrum of the string in the conventional structure will constitute a connecting point 62 with the bridge saddle 74. Since the distance between the fulcrum 62 of this string and the terminal part 61 is large, a change in the tension of the string should have occurred. In such case, when the tremolo is played, it causes the fulcrum to move, thereby making it unstable and exerting an undesirable effect upon the reproduction of correct sound.

The present invention, however, owing to the construction of the saddle and the interrelationship of the parts 20 for harmonious tone adjustment and 45 for pitch adjustment and 51–42 for retention of the string, the parts will all remain stable. In the utilization of tremolo, no maladjustment will occur, as can occur in the prior art as described above. The string mounting provides for a structure in which it is not only possible to produce the correct sound without change or distortion but the string is also easy to install and it is possible to make adjustments from the rear part of the string at the area of attachment.

In summary, a string is inserted into the holding groove of a tuning member which is freely rotatable in the main bridge saddly body. At the same time, a securing member which has a string securing jaw part and a tightening screw running through it is inserted into the holding groove. The tightening screw is screwed to the tuning member, thereby holding and maintaining the string in the string securing jaw part of the fixing member.

Although the present invention has been described in connection with a plurality of preferred embodiments thereof, many variations and modifications will now become apparent to those skilled in the art.

What is claimed is:

1. A bridge tuning mechanism for carrying, supporting and fine tuning the string of a musical instrument, the tuning mechanism comprising:

a base and means for securing the base to the body of said instrument; a plurality of saddles mounted at the base next to one another; a plurality of strings individual to each saddle; each saddle having securing means individual for each string;

means for obtaining a further adjustment of the saddle to vary the tension on each string; and additional means for varying the harmonic tuning of each string;

arranging said securing means for the string on each saddle so that the means for adjusting tension of the string may be operated independently of the means for securing the strig to the saddle;

said string securing means comprising a vertical groove in said saddle arranged generally perpendicular to the surface of the instrument on which said saddle is mounted;

said groove having an upper end and a lower end;

a bead on said string insertable from the upper end of said groove; means at the lower end of said groove for retaining said bead;

a bearing surface on said saddle adjacent the upper end of said groove, said string passing over said bearing surface and a clamping member carried by said saddle, said clamping member engaging said string and said bearing surface to retain the end of said string in place on said saddle.

2. The bridge tuning mechanism of claim 1, wherein said clampiong member includes a jaw engageable with said string on said bearing surface; a screw vertically adjustable in said saddle, said screw being movable to a position where the head of the screw engages the clamping jaw and thereby engaes the string on the bearing surface of said saddle.

3. The bridge tuning mechanism of claim 2, wherein said screw and the portion of said groove extending downwardly in said saddle are parallel to each other.

4. The bridge tuning mechanism of claim 2, wherein the adjustment for changing the effective length of the string and the adjustment for changing the tension of the string are on the same side of said saddle and said string engaging clamp is on the opposite side of said saddle.

5. The bridge tuning mechanism of claim 4, wherein the screw which operates the clamping jaw extends between the string and its bearing point and jaw and the tuning mechanism on the bridge for harmonically tuning and pitch tuning guitar strings.

* * * * *